US006709517B1

(12) United States Patent
Holtmann et al.

(10) Patent No.: US 6,709,517 B1
(45) Date of Patent: Mar. 23, 2004

(54) METHOD AND DEVICE FOR COATING A RUNNING MATERIAL WEB

(75) Inventors: Bruno Holtmann, Dielsdorf (CH); José Antonio Mena, Bülach (CH); Rolf Metzger, Wallisellen (CH); Luca Frediani, Zürich (CH)

(73) Assignee: Bachofen + Meier AG Maschinenfabrik, Bulach (CH)

( * ) Notice: Subject to any disclaimer, the term of this patent is extended or adjusted under 35 U.S.C. 154(b) by 0 days.

(21) Appl. No.: 10/168,364

(22) PCT Filed: Nov. 11, 2000

(86) PCT No.: PCT/EP00/11170

§ 371 (c)(1),
(2), (4) Date: Jun. 17, 2002

(87) PCT Pub. No.: WO01/47643

PCT Pub. Date: Jul. 5, 2001

(30) Foreign Application Priority Data

Dec. 23, 1999 (DE) ..... 199 62 844

(51) Int. Cl.[7] ..... B05C 5/00
(52) U.S. Cl. ..... 118/326; 118/DIG. 4; 427/420
(58) Field of Search ..... 118/DIG. 4, 323–326; 427/420

(56) References Cited

U.S. PATENT DOCUMENTS 4,559,896 A * 12/1985 Bossard et al. ..... 118/300
4,647,482 A * 3/1987 Degrauwe et al. ..... 427/420
5,395,660 A 3/1995 Ruschak et al.
5,569,492 A * 10/1996 Devine et al. ..... 427/286
5,885,659 A * 3/1999 Takahashi et al. ..... 427/420
5,908,668 A 6/1999 Bulow et al.
6,117,236 A * 9/2000 Ruschak et al. ..... 118/300
6,468,592 B1 * 10/2002 Becker et al. ..... 427/420

FOREIGN PATENT DOCUMENTS

| | | |
|---|---|---|
| DE | 19735558 | 2/1999 |
| GB | 1 099 127 | 1/1968 |
| JP | 61035880 | 2/1986 |

* cited by examiner

*Primary Examiner*—Richard Crispino
*Assistant Examiner*—Michelle Awedo Lazor
(74) *Attorney, Agent, or Firm*—Herbert Dubno; Andrew Wilford

(57) ABSTRACT

The aim of the invention is to coat running material webs (1). According to prior art, the coating material is applied to the material web (1) by means of curtain coaters. Said coating material is discharged from a slit nozzle (2) and passes through a free-falling curtain (3). The edges of the curtain (3) are separated by means of separating elements (9, 10) before the fall into the material web (1) for adjusting the coating width. According to the invention, a smaller curtain is produced on each edge by means of a first outer separating element (10). Said curtain is adjusted to the desired coating width by means of a second, inner separating element (9). In a preferred embodiment, an inner separating element (9) is used which contains a vertical channel in the interior thereof. Said channel is open on the separating edge. A water supply (24) flows into said channel.

13 Claims, 5 Drawing Sheets

METHOD AND DEVICE FOR COATING A RUNNING MATERIAL WEB

CROSS REFERENCE TO RELATED APPLICATIONS

This application is the US national phase of PCT application PCT/EP00/11170 filed Nov. 11, 2000 with a claim to the priority of German application 199 62 844.0 filed Dec. 23, 1999.

FIELD OF THE INVENTION

The invention relates to a method of coating a running material web wherein the coating material is applied as a free-falling curtain to the web and the edges of the curtain are split off by splitters at both sides for setting the coating width before contact with the material web. In addition the invention concerns a coating device that is particularly suited for carrying out the method according to the invention and to a splitter particularly usable in the coating device.

BACKGROUND OF THE INVENTION

In order to coat a running material web, for instance of paper, cardboard, plastic, or metal, so-called curtain coaters are used where the coating material (pigment, plastic dispersion, etc.) is applied from a slot nozzle in a free-falling curtain to the material web. In order to produce a stable and uniform curtain across the coating width, WO 98/47630 and DE 197 35 588 describe how the two curtain edges are guided by respective guides extending downward from the slot nozzle to near the material web. In order to set the desired curtain width, the curtain edges are split off before the curtain actually contacts the material web by splitters that extend transverse to the web-travel direction underneath the guides. The two splitters each have an upwardly directed splitting edge and an outwardly directed inclined upper catching surface on which the material split from the edge of the curtain can flow outward.

If the curtain coater is used to apply dispersion adhesives to a web-shaped splitter in the production of self-sticking labels, release strips, etc. or to apply a barrier layer in the production of a water-impermeable packing material, it is necessary to be able to set the coating width over a wide range since the web width varies considerably depending on the material being coated.

OBJECTS OF THE INVENTION

It is therefore an object of the invention to improve on a method of and apparatus of the described type such that widely varying coating widths can be set without diminishing the coating quality.

A further object of the invention is to provide a splitter that is particularly suited for use in the coating apparatus according to the invention.

SUMMARY OF THE INVENTION

This object is attained in that first a first outer splitter at each edge creates a narrow curtain and then a second inner splitter at each edge creates the desired coating width.

The provision of two splitters on each side makes it possible to set a very narrow coating width by splitting off a substantial lateral region of the curtain without coating errors on the longitudinal edges. In order to avoid coating errors (variations in the application density or the coating width, gaps in the curtain, etc.) inner splitters are used whose splitter edges are very short. The bulk of the flow of coating material is split off by the outer splitters whose edges are sufficiently high that they avoid an overflow of the split-off coating material. The inner splitters take care of the rest of the curtain edge. They can thus have a lower height without the split-off coating material flowing inward over the splitting edge as is not wanted. A shorter height of the splitting edge of the inner element is advantageous since its inner edge extending parallel to the flow direction of the curtain also serves to guide the curtain edge. Too great a height allows separation of the curtain edge from the inner face too far above the web being coated. In this case its position moves and a ridge is formed of the coating material on the material web.

BRIEF DESCRIPTION OF THE DRAWING

The drawings serve to describe the invention with reference to simplified illustrated embodiments. Therein.

SPECIFIC DESCRIPTION

The coating apparatus shown in the figures serves for applying a dispersion adhesive (e.g. an acrylate) in a water solution to a siliconized paper web 1. As a result of its advantageous features the apparatus also serves for applying other dispersions to paper, plastic foils, or thin strips or to coat paper or cardboard webs with paint.

It has a slot nozzle 2 that is hung above the path of the web 1 in the frame of the applicator. The slot nozzle 2 is connected to an unillustrated supply of coating material and has on its underside a slot-shaped opening from which the coating material flows out and forms a free-falling curtain 3 that drops onto the upper web surface. The width of the slot of the nozzle 2 is greater than the maximum width of the web 1.

Underneath the slot nozzle 2 the web 1 is supported over its entire width by a support roller 4. The support roller 4 engages the uncoated web 1 from below. After being coated, the web 1 leaves the support roller 4 generally horizontally.

Figure 1:
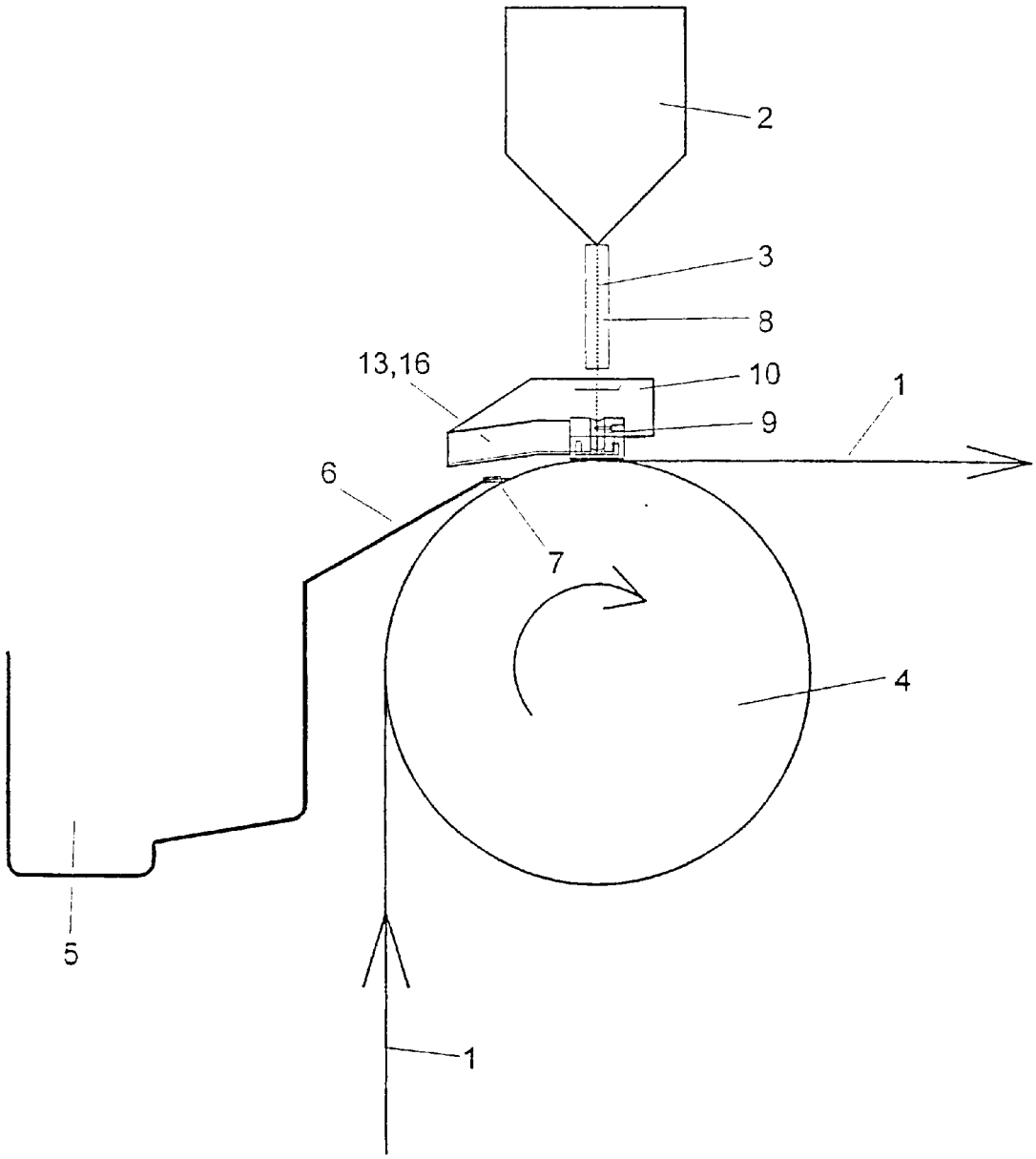
FIG. 1 is a longitudinal section through a curtain coater according to the invention.
Figure 2:
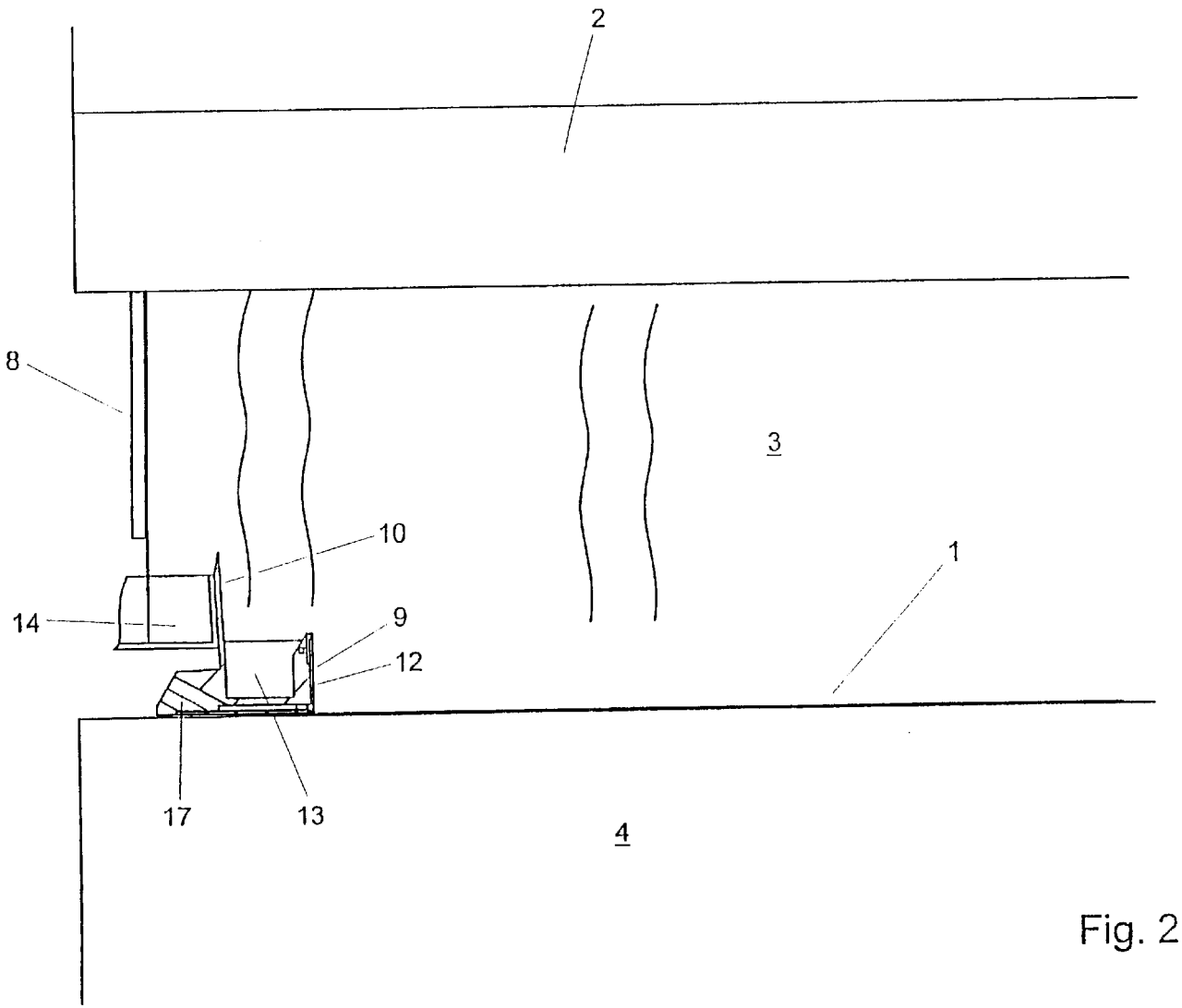
FIG. 2 is the edge region in a cross section through the web.

The slot nozzle 2 is vertically adjustable above the top centerline of the support roller 4 in order to be able to set the spacing of the outlet slot from the web 1 and thus the distance through which the coating material will fall. In addition the slot nozzle 2 is movable horizontally in and against a web-travel direction so that it can be moved upstream from the region directly above the center of the support roller 4 to a region upstream of the support roller 4. Here the slot nozzle 3 is above a catch trough 5 that is arranged immediately upstream of the support roller 4 above the web 1. In this position when the coating apparatus is started at first a stable curtain 3 is produced that falls into the catch trough 5. Thereafter the slot nozzle 2 with the attached elements is moved in the web-travel direction—to the right in FIG. 1—into its working position above the support roller 4. The region between the downstream side of the catch trough 5 and the top centerline of the counter roller 4 is covered by a catch plate 6 extending over the entire working width. The end of the catch plate 6 is provided with a scraper 7 that limits the surface air entrained by the web 1 before engaging the curtain 3.

Since the free-falling curtain 3 tends as a result of surface tension to deflect inward on its edges, on both sides of the slot nozzle 2 there are fixed bar-shaped guides 8 that extend down to immediately adjacent the web 1. Preferably the two guides 8 are each fixed immediately next to the outlet slot of the slot nozzle 2 and their inner faces turned toward the curtain 3 are smooth. As described in German 197 35 558 the inner face of each guide 8 is coated with a supplemental liquid that reduces surface tension, preferably water. The supplemental liquid flowing downward on the guides 8 serves to hold the curtain 3 better on the guides 8. Alternatively the guides 8 can be inclined inward.

Both longitudinal sides of the coating apparatus have means underneath the guides 8 for limiting the curtain 3 to the desired coating width. The limiting means are each mounted on the frame of the nozzle 2 so that when the nozzle 2 is shifted in or against the web-travel direction they move synchronously. In addition they are movable transverse to the web-travel direction in order to be able to set the width of the curtain 3 falling on the web 1 to widely different web widths. The edge-limiting means on both sides are mounted and constructed symmetrically to each other. They can be transversely adjustable independently of each other.

Figure 3:
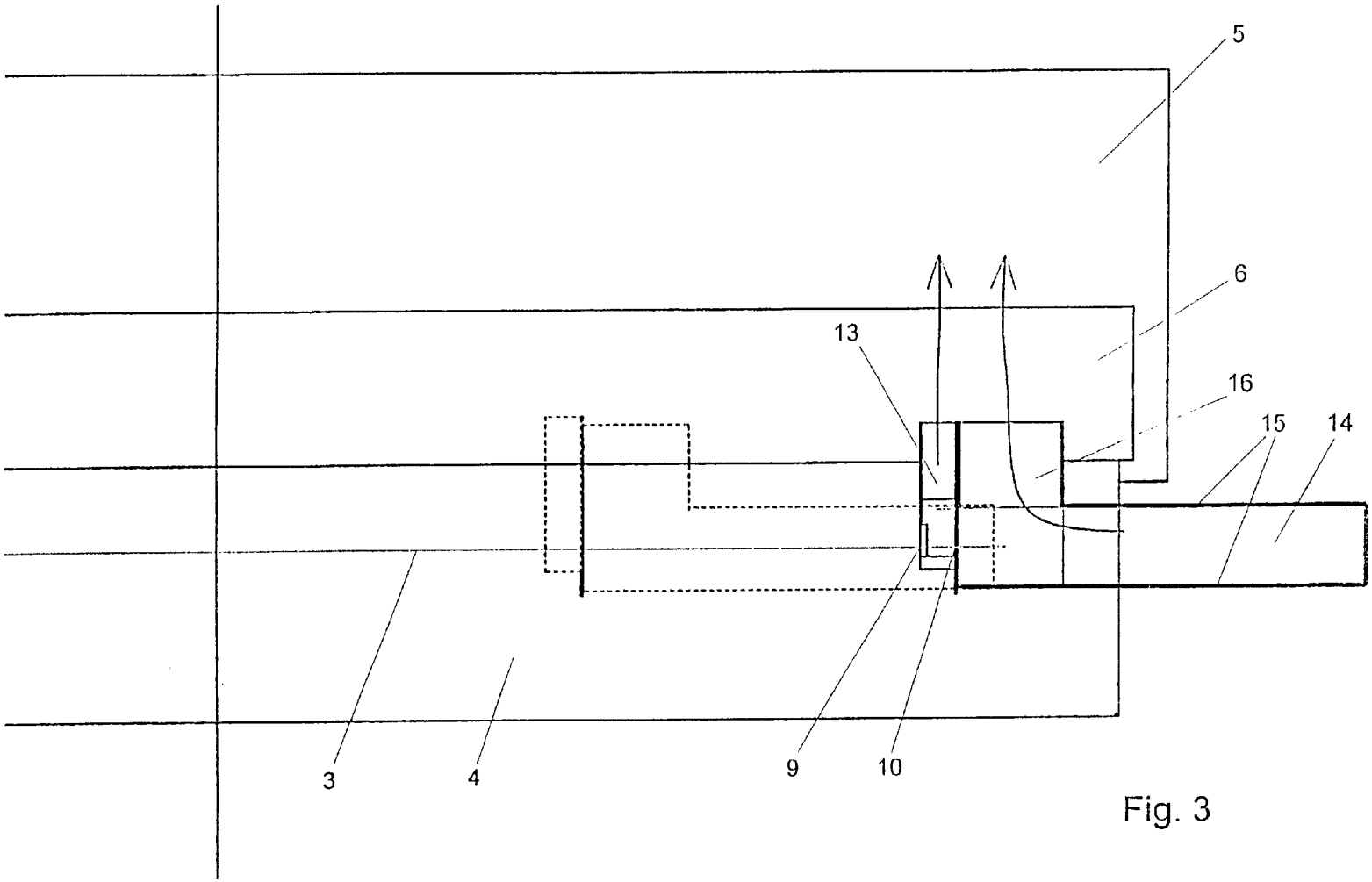
FIG. 3 is a top view of an edge region.

The edge-limiting means are each comprised of two blade-shaped generally upright and spaced splitters 9 and 10 that are mounted on the longitudinal sides of a floor plate 11. Each of the splitters 9 and 10 ends in a sharp splitting edge and the splitting edge of the inner splitter 9 is set so low that the curtain 3 does not separate from its inner face 12 before it contacts the web 1. Each inner splitter 9 forms with the respective outer splitter 10 and the base plate 11 an edge trough 13 that conducts away the coating material falling between the two respective splitters 9 and 10. As visible in FIG. 3 the splitters 9 and 10 are extended upstream to form the trough 13 so that its end is above the catch plate 6. The floor plate 11 is inclined downward so that the caught coating material drops down onto the catch plate 6 and thence runs off toward the catch trough 5.

Figure 4:
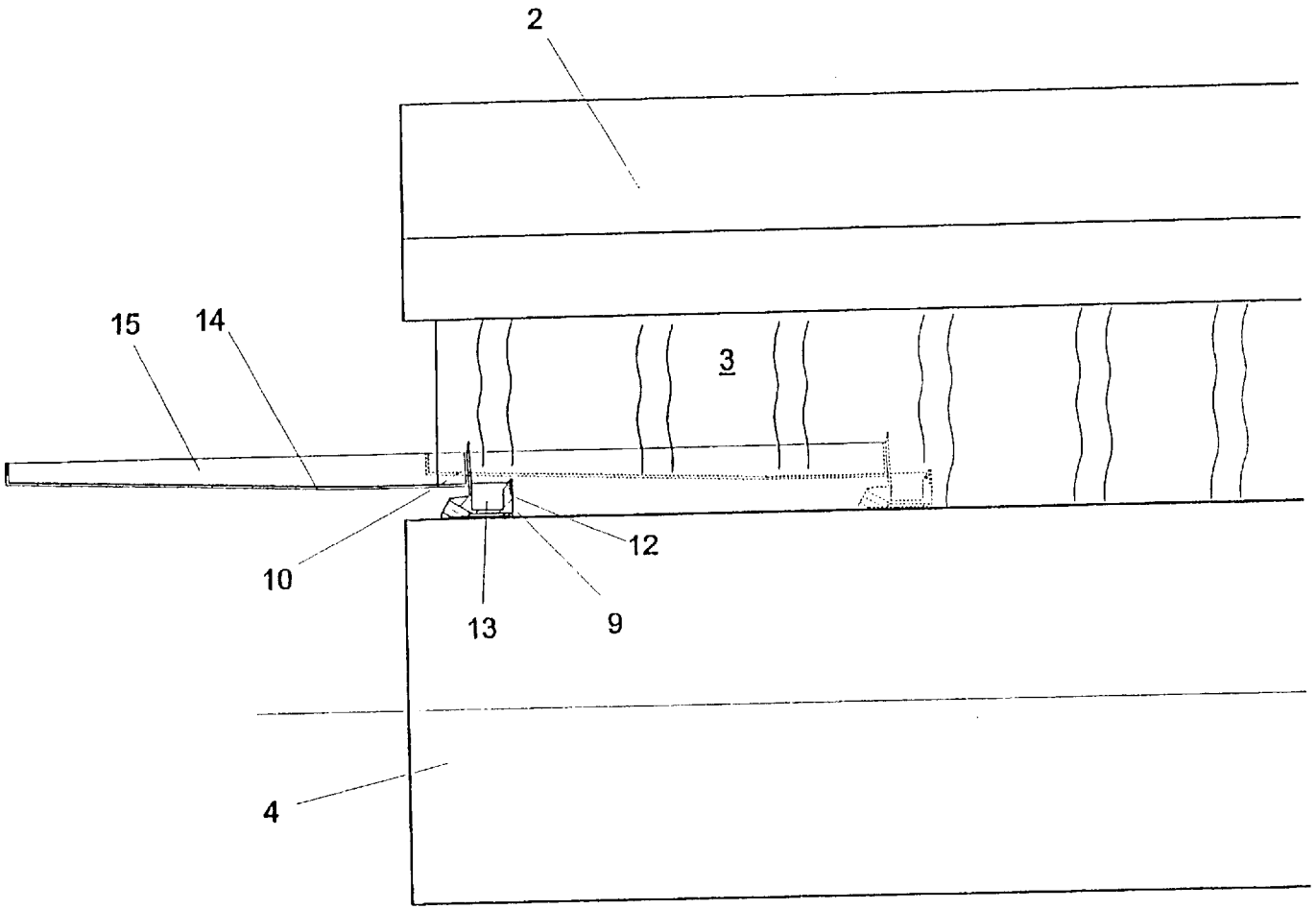
FIG. 4 is a cross section through the adjuster for splitting off the edge.
Figure 5:
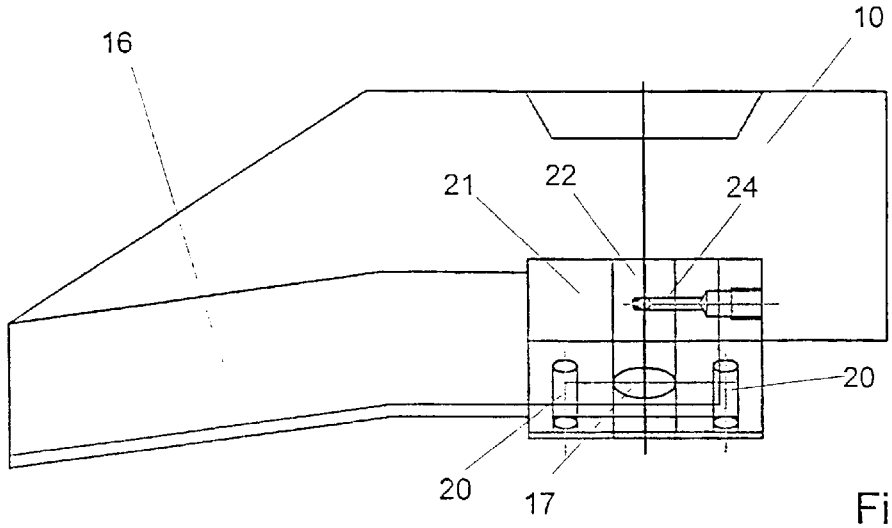
FIG. 5 is a longitudinal section through a splitter.
Figure 6:
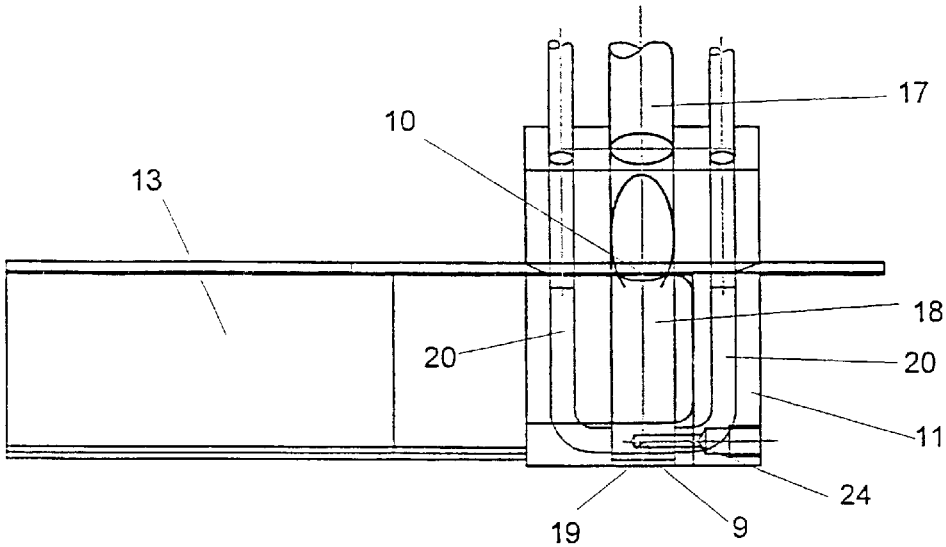
FIG. 6 is the corresponding top view.

On the outside face of the splitter 10 is a transverse trough 14 positioned to catch the outer curtain edge. The length of each transverse trough 14 measured transverse to the web-travel direction is such that when a minimal coating width is set the trough outer ends will extend out to below the respective guide 8, that is past the lateral edge of the outlet slot of the nozzle 2. Each transverse trough 14 has side walls 15 (FIG. 4) that extend up to the splitter edge of the respective splitter 10. The splitters 10 close the inner ends of the respective troughs 14. Trough depth is sufficient to catch and carry away the split-off coating liquid with minimal coating width without any overflow. Preferably the transverse troughs 14 have floors that are inclined inward and the troughs 14 each drain at their inner ends near the splitter 10 into a respective outlet trough 16. The outlet troughs 16, which project against the web-travel direction also to the region above the catch plate 6, conduct the coating material into the catch trough 5. The inwardly inclined transverse trough 14 with the outlet trough 16 arranged against the respective splitter 10 has two advantages: First, the catch trough 5 only need extend over the axial length of the support roller 4 since, even with maximum coating width, the outlet trough 16 is near the counter roller. Second, the outer end of the transverse trough 14 will not touch the support roller 4 when the blades 9 and 10 are shifted with the transverse troughs 14 inward to a minimal coating width as shown in dashed lines in FIG. 4.

In operation the two splitters 9 and 10 with the respective transverse troughs 14 are moved inward until the inner splitters 9 are set at the location of the desired coating edges. The outer splitter 10 that is taller splits off the outer portion of the curtain edge and diverts it to the transverse trough 14 so it can flow via the outlet trough 16 into the catch trough 5. This leaves a narrower inner curtain whose edges are split off by the inner splitters 9 and diverted out via the edge troughs 13. The inner faces 12 of the splitters 9 thus serve as guides for the edges of the curtain portion that is applied to the web 1. The shorter height of the splitters 9 ensures that the curtain edges do not separate from them before contacting the web 1.

In order to avoid forming a longitudinal ridge of coating material along an edge of the web 1, the lower Bide of each edge trough 13 is provided with a suction line 17 that opens via a suction conduit 18 in the floor plate 11 into a suction slot 19 in the inner face 12 of the respective inner splitter 9. The suction slot 19 extends at a spacing of 0.1 mm–1.0 mm from the web 1 on the lower side of the splitter 9 near the curtain 3. It has a length in the web-travel direction of 2 mm–15 mm, preferably 3 mm–5 mm, so that the suction is maintained even with some movement of the curtain 3. The suction conduit 17 extends out below the transverse trough 14 and is connected to a pump with a separator for the coating material. In order to prevent caking in the suction slot 19, it is flushed with water. To this end there is parallel to the suction line 17 a pair of water-supply lines 20 that are immediately adjacent and open into the suction conduit 18. The flushing water is carried away together with the suctioned-off coating material through the suction line 17.

The length of the suction conduit 18 in the base plate 11 is the same as the spacing of the splitters 9 and 10 from each other. It should be as small as possible in order that too much pressure is not lost and there is no caking in the passage 18. A short suction conduit 18 is made possible by a narrow edge trough 13 that must only carry away a small stream of split-off coating material.

In order to maintain the curtain edges against the inner faces 12 of the splitters 9, these faces 12 are sprayed with a supplemental liquid. This supplemental liquid is such that it flows from the splitter edge of the splitter 9 down both sides of the splitter 9. This downwardly flowing supplemental liquid thus forms a supplemental liquid layer immediately beneath the splitter edge of the splitter 9 so as to prevent caking of coating material at the splitter edge.

Figure 7:
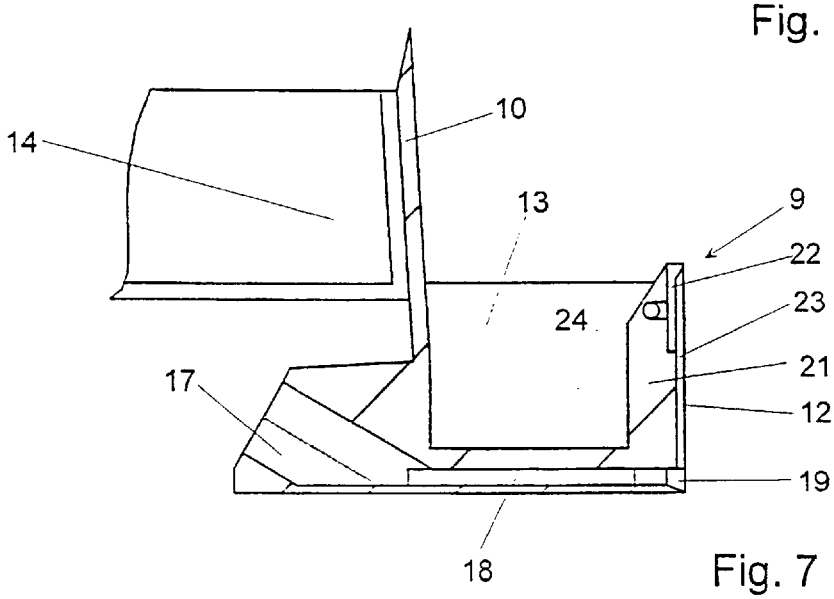
FIG. 7 is the corresponding cross section

As shown in FIG. 7, the splitter 9 is made of two parts, a side wall 21 having a sharp edge is mounted on the floor plate and is formed in its upper part on the outside face with an upwardly open groove 22. On the outside of the wall 21 is a thin blade-shaped cover plate 23 that extends over the groove 22 and thus forms a passage open at the splitter edge. A water-supply line 24 opens into this passage. The water fed in from the supply line 24 exits from the top of the split edge and runs down the inner face of the plate 21 as a supplemental liquid stabilizing the curtain and also along the wall 21 into the edge trough 13. The entire splitter 9 is thus coated with water so as to prevent any caking of the coating material on the splitter 9.

Alternatively to the provision of an additional supplemental liquid, caking on the splitter 9 can be prevented by cooling. Cooling forms condensate on the outer surfaces that form a liquid layer for the coating liquid. Cooling of the splitter 9 can be done by pumping cold water through cavities inside the splitter 9. Alternately the cooling can be done by means of one or more Peltier elements that are mounted for example inside the edge groove 13 on the side wall 21. Such cooling elements have the advantage that they need no external equipment.

What is claimed is:

1. An apparatus for coating a web running in a travel direction, the apparatus comprising:

means including a slot nozzle for forming a free-falling curtain of coating liquid extending transversely of the direction and dropping on the web;

means including two inner splitters spaced transversely of the direction for splitting off outer portions of the curtain such that the coating liquid is applied to the web over a coating width equal to a transverse spacing of the inner splitters;

two outer splitters spaced transversely of the direction underneath the nozzle outside the inner splitters, the inner and outer splitters having upper edges that intercept the curtain, the inner-splitter upper edges being below the outer-splitter upper edges; and respective inner and outer troughs immediately outside the inner and outer splitters, positioned to catch the coating liquid split off the curtain by the respective inner and outer splitters, and shaped to channel the caught coating liquid parallel to the direction.

2. The web-coating apparatus defined in claim 1, further comprising respective floor plates each extending horizontally between the inner splitters and the respective outer splitters, the floor plates forming the inner troughs with the respective inner and outer splitters; and drain means for withdrawing the liquid from the inner troughs.

3. The web-coating apparatus defined in claim 1 wherein the splitters are transversely displaceable between outermost and innermost positions, the outer troughs being of such a length that they extend transversely outwardly past ends of the slot nozzle when the respective splitters are in the innermost positions.

4. The web-coating apparatus defined in claim 1 wherein each outer trough has a floor inclined downward toward the respective outer splitter, each outer trough draining into the respective inner trough.

5. The web-coating apparatus defined in claim 4, further comprising means for flushing the troughs with a liquid.

6. The web-coating apparatus defined in claim 1 wherein each inner splitter has a lower edge and is formed thereadjacent with a suction slot, the apparatus further comprising means for applying suction to the slots and thereby adhering the curtain to inner faces of the inner splitters.

7. The web-coating apparatus defined in claim 6 wherein each slot is spaced between 0.01 mm and 1 mm from the web.

8. The web-coating apparatus defined in claim 6 wherein each slot has a length measured in the direction of between 2 mm and 15 mm.

9. The web-coating apparatus defined in claim 6 wherein each slot has a length measured in the direction of between 3 mm and 5 mm.

10. The web-coating apparatus defined in claim 1 wherein each inner splitter has an inner face, the apparatus further comprising means for coating the inner faces with water.

11. The web-coating apparatus defined in claim 1 wherein each inner splitter is formed at its inner face with a groove into which the water is introduced to coat the respective inner face.

12. The web-coating apparatus defined in claim 1, further comprising means for cooling inner faces of the inner splitters.

13. An apparatus for coating a web running in a travel direction, the apparatus comprising:

means including a slot nozzle for forming a free-falling curtain of coating liquid extending transversely of the direction and dropping on the web;

means including two inner splitters spaced transversely of the direction for splitting off outer portions of the curtain such that the coating liquid is applied to the web over a coating width equal to a transverse spacing of the inner splitters;

two outer splitters spaced transversely of the direction underneath the nozzle outside the inner splitters, the inner and outer splitters having upper edges that intercept the curtain, the inner-splitter upper edges being below the outer-splitter upper edges; and respective inner and outer troughs immediately outside the inner and outer splitters, positioned to catch the coating liquid split off the curtain by the respective inner and outer splitters, and shaped to channel the caught coating liquid parallel to the direction, each outer trough draining into the respective inner trough and having a floor inclined downward toward the respective outer splitter.

* * * * *